US006729591B2

(12) United States Patent
Hsu

(10) Patent No.: US 6,729,591 B2
(45) Date of Patent: May 4, 2004

(54) PAPER ATTACHMENT DEVICE

(75) Inventor: Nick Hsu, Taichung (TW)

(73) Assignee: Synchro Ent. Co., Ltd., Taichung (TW)

( * ) Notice: Subject to any disclaimer, the term of this patent is extended or adjusted under 35 U.S.C. 154(b) by 0 days.

(21) Appl. No.: 10/266,113

(22) Filed: Oct. 7, 2002

(65) Prior Publication Data

US 2003/0146356 A1 Aug. 7, 2003

(30) Foreign Application Priority Data

Feb. 7, 2002 (TW) ..... 91201451 U

(51) Int. Cl.[7] ..... A45D 42/14

(52) U.S. Cl. ..... 248/205.6; 248/206.5; 248/441.1; 248/683

(58) Field of Search ..... 248/205.1, 206.5, 248/683, 450, 451, 441.1, 205.2

(56) References Cited

U.S. PATENT DOCUMENTS 3,738,499 A * 6/1973 Takamizawa et al. ..... 211/120

FOREIGN PATENT DOCUMENTS

JP 11091278 A * 4/1999

* cited by examiner

*Primary Examiner*—Ramon O. Ramirez
(74) *Attorney, Agent, or Firm*—William E. Pelton, Esq.

(57) ABSTRACT

A paper attachment device is composed of a cap (10), a cup (20), a driving plate (30) and a magnet (40) axially combined in sequence. The cap (10) has a stud movably penetrating through the cup (20) and the driving plate (30) and firmly secured with the magnet (40). The driving plate (30) has multiple resilient arms (30) pressing the cup (20) toward the cap (10), whereby paper can be held between the cup (20) and the cap (10) to make the paper attachment device versatile in usage.

8 Claims, 5 Drawing Sheets

PAPER ATTACHMENT DEVICE

BACKGROUND OF THE INVENTION

1. Field of the Invention

The present invention relates to a paper attachment device, and more particularly to a paper attachment device that can attach multiple sheets paper to a magnetic surface in two ways.

2. Description of Related Art

With reference to FIG. 7, a conventional paper attachment device (60) mounted on a whiteboard (50) is usually composed of a magnet and a plastic shell housing the magnet inside. The magnet provides a magnetic force to detachably mount the paper attachment device (60) on the whiteboard (50) whereby multiple pieces of paper are squeezed and held between the whiteboard (50) and the paper attachment device (60) by the magnetic force.

There are, however, two problems with this conventional paper attachment device (60):

1. In particular, only a few pieces of paper can be held between the whiteboard (50) and the paper attachment device (60) because the magnetic force is only strong enough. Therefore, the paper attachment device (60) easily drops off the magnetic surface or will not attach to the whiteboard (50).

2. To change the piece of paper, the paper attachment device (60) has to be removed from the whiteboard (50) to remove the paper and replace it with a new sheet. Then, the paper attachment device (60) is placed on the new paper to attach the paper to the whiteboard (50). Therefore, a person must perform multiple steps to change the paper.

The present invention has arisen to mitigate and/or obviate the disadvantages of the conventional paper attachment device.

SUMMARY OF THE INVENTION

The main objective of the present invention is to provide a paper attachment device that can attach multiple pieces of paper to a magnetic surface in two ways.

Further benefits and advantages of the present invention will become apparent after a careful reading of the detailed description with appropriate reference to the accompanying drawings.

DETAILED DESCRIPTION OF THE INVENTION

Figure 1:
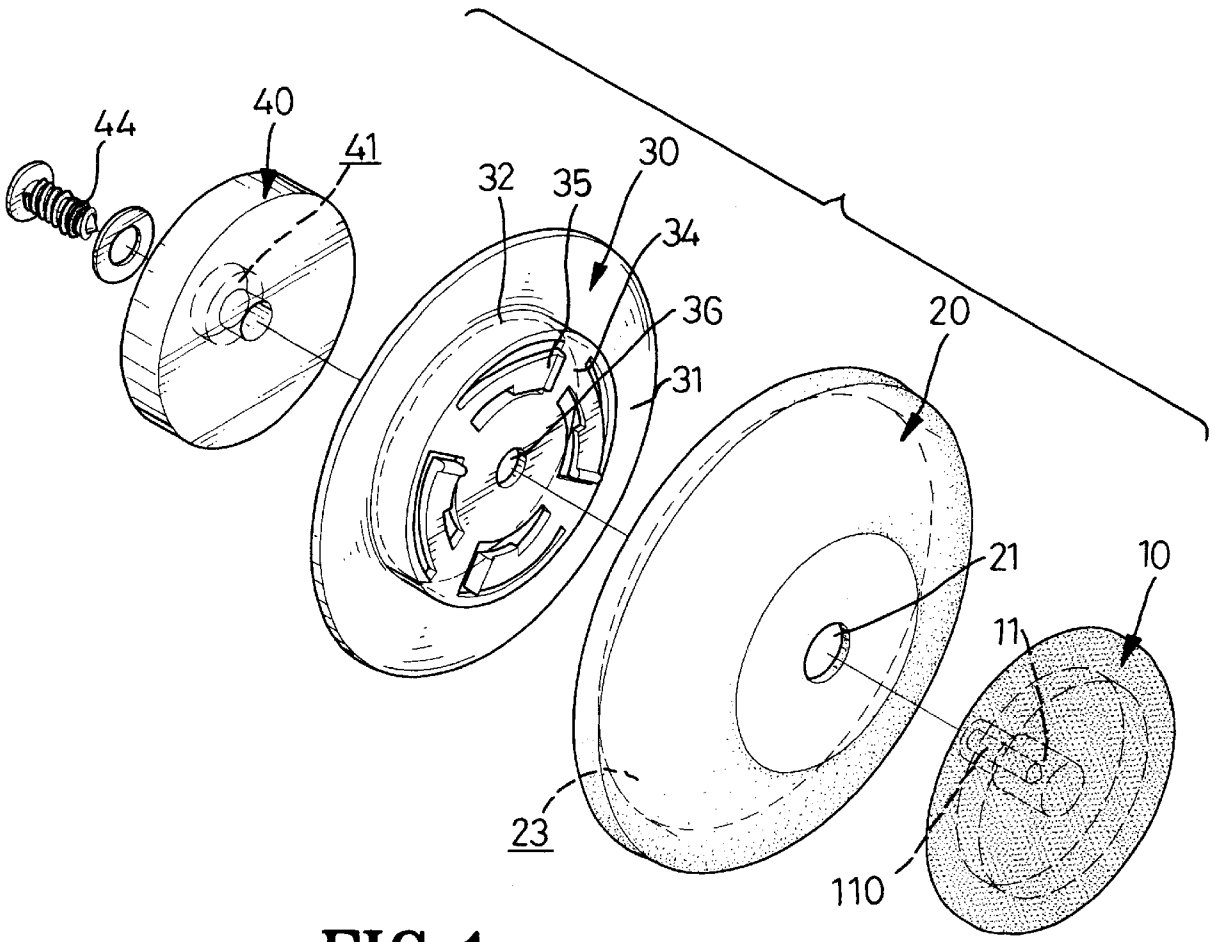
FIG. 1 is an exploded perspective view of a paper attachment device in accordance with the present invention.
Figure 2:
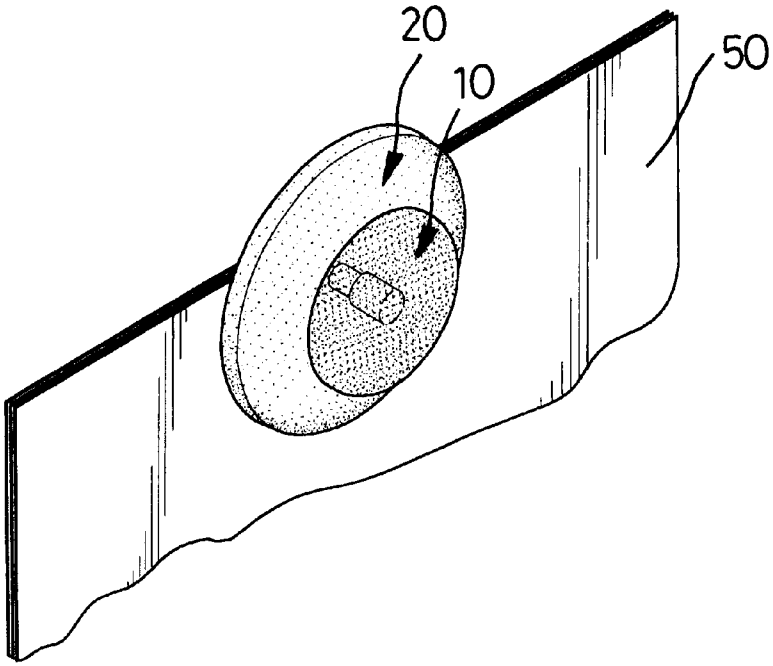
FIG. 2 is a perspective view of the paper attachment device in FIG. 1 showing multiple pieces of paper attached by magnetic force.
Figure 3:
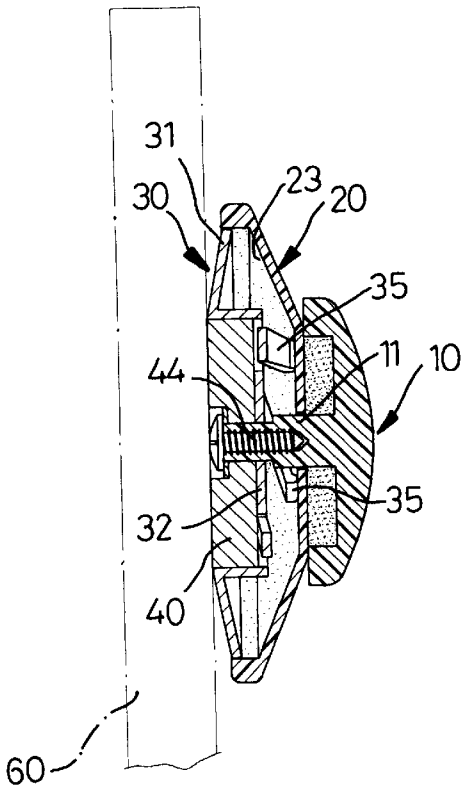
FIG. 3 is a cross-sectional side plan view of the paper attachment device in FIG. 2 when the paper attachment device is attached to a magnetic surface.

With reference to FIGS. 1 to 3, a paper attachment device in accordance with the present invention is composed of a cap (10), a cup (20), a driving plate (30), and a magnet (40).

The cap (10) is a dome with a concave inner surface, an opening and a flat edge around the opening. A stud (11) extends from the concave inner surface toward the cup (20). The stud (11) has a distal end and a threaded hole (110) is formed longitudinally in the distal end of the stud (11). The flat edge around the opening allows users to hold the cap (10) easily.

The cup (20) is also a dome with an inner recess (23), a center and an outer periphery. A through hole (21) is defined in the center of the dome through which the stud (11) of the cap (10) passes, and the cap (10) is mounted on the outer periphery of the cup (20).

The driving plate (30) is a circular plate, has a center and a top surface (34) and is movably mounted inside the inner recess (23) of the cup (20). A housing (32) with a top surface (34) is formed in the center of the driving plate (30) to hold the magnet (40). Multiple resilient arms (35) are formed on the top surface (34) of the housing (32) and extend toward the cup (20). A hole (36) is defined through the housing (32) to align with the through hole (21) in the cup (20). Additionally, the resilient arms (35) are curved and formed around the top surface (34) of the housing (32) to press against the cup (20) to provide a regular resisting force to the cup (20) when the cup (20) is compressed.

The magnet (40) is mounted inside the housing (32) of the driving plate (30) and has a counter sunk hole (41) defined through the magnet (40) to align with the hole (36) in the driving plate (30). Means to moveably connect the cap (10) to the other elements of the paper attachment device is provided at the end of the stud (11). In the preferred embodiment, a bolt (44) is mounted in the counter sunk hole (41) screws into the threaded hole (110) in the stud (11) that passes through the through hole (21) in the cup (20), the hole (36) in the driving plate (30) and into the magnet (40).

Figure 4:
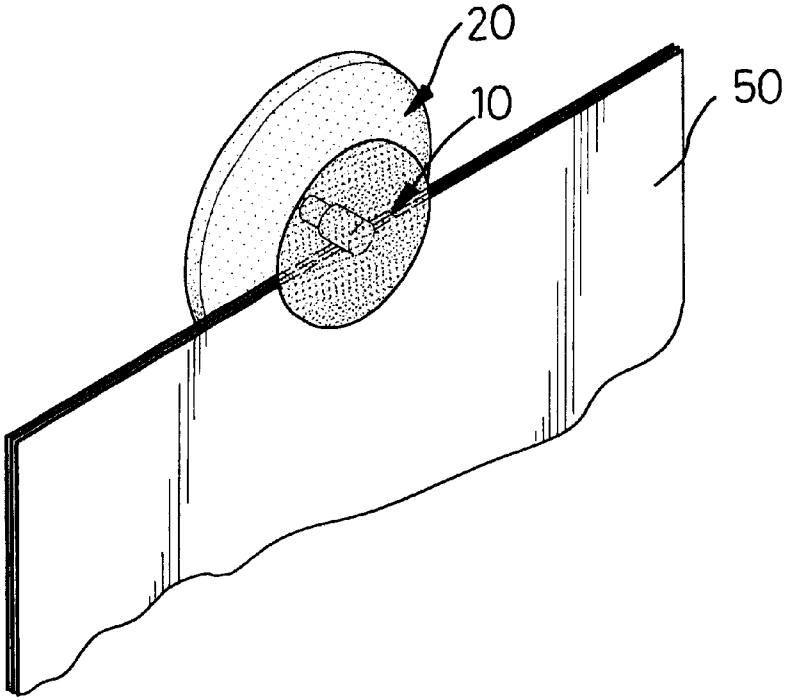
FIG. 4 is a perspective view of the paper attachment device in FIG. 1 showing multiple pieces of paper attached to the paper attachment device by a clipping force.
Figure 5:
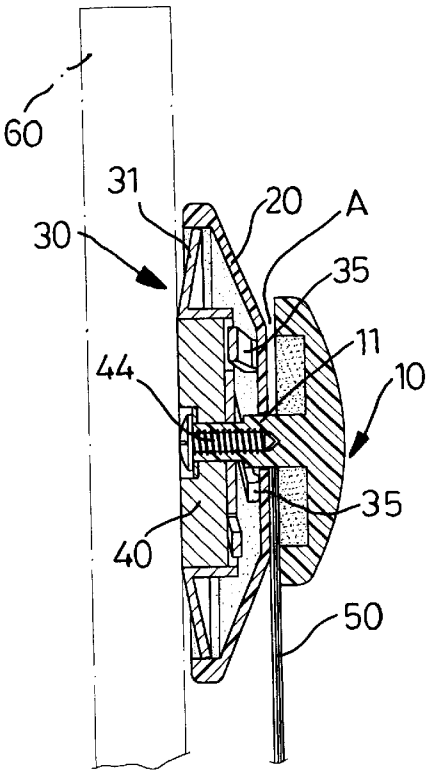
FIG. 5 is a cross-sectional side plan view of the paper attachment device in FIG. 4 with the paper attachment device clipping multiple pieces of paper.

With reference to FIGS. 2 and 3, one way of attaching sheets of paper (50) to a magnetic surface such as a whiteboard (60) is to sandwich the multiple pieces of paper (50) between the whiteboard (60) and the paper attachment device in a conventional way. With reference to FIGS. 4 and 5, another way for the paper attachment device to hold paper (50) is to press the cup (20) toward to the whiteboard (60). The cup (20) presses the resilient arms (35) on the driving plate (30) and form a gap (A) between the cap (10) and cup (20). Pieces of paper (50) can be put into the gap (A). When the cup (20) is released, the resilient arms (35) push the cup (20) back toward the cap (10). The resilient arms (35) acting on the cup (20) securely hold the paper between the cup (20) and the cap (10). Therefore, the paper attachment device does not need to be detached from the whiteboard (60) to change or remove pieces of paper (50) and the paper (50) does not form a buffer between the magnetic surface and the magnet (40).

Figure 6:
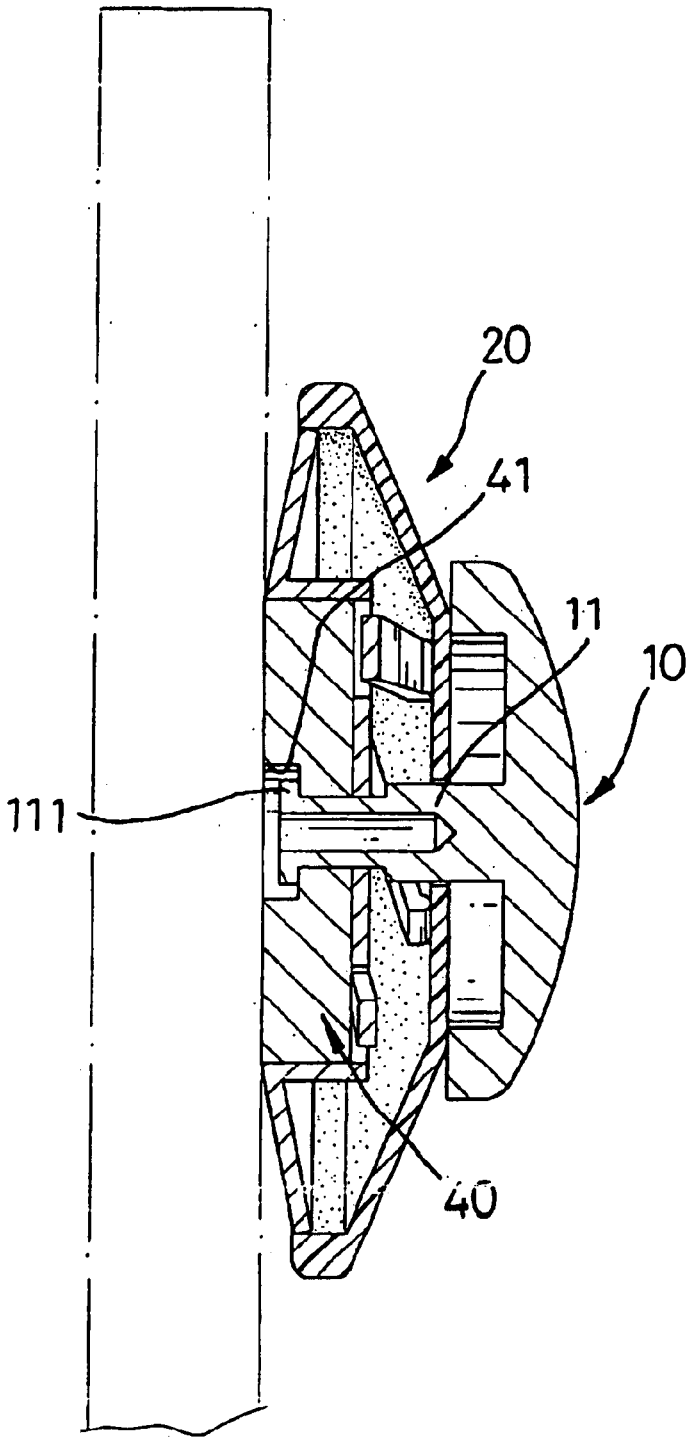
FIG. 6 is a cross-sectional side plan view of another embodiment of the paper attachment device in accordance with the present invention.
Figure 7:
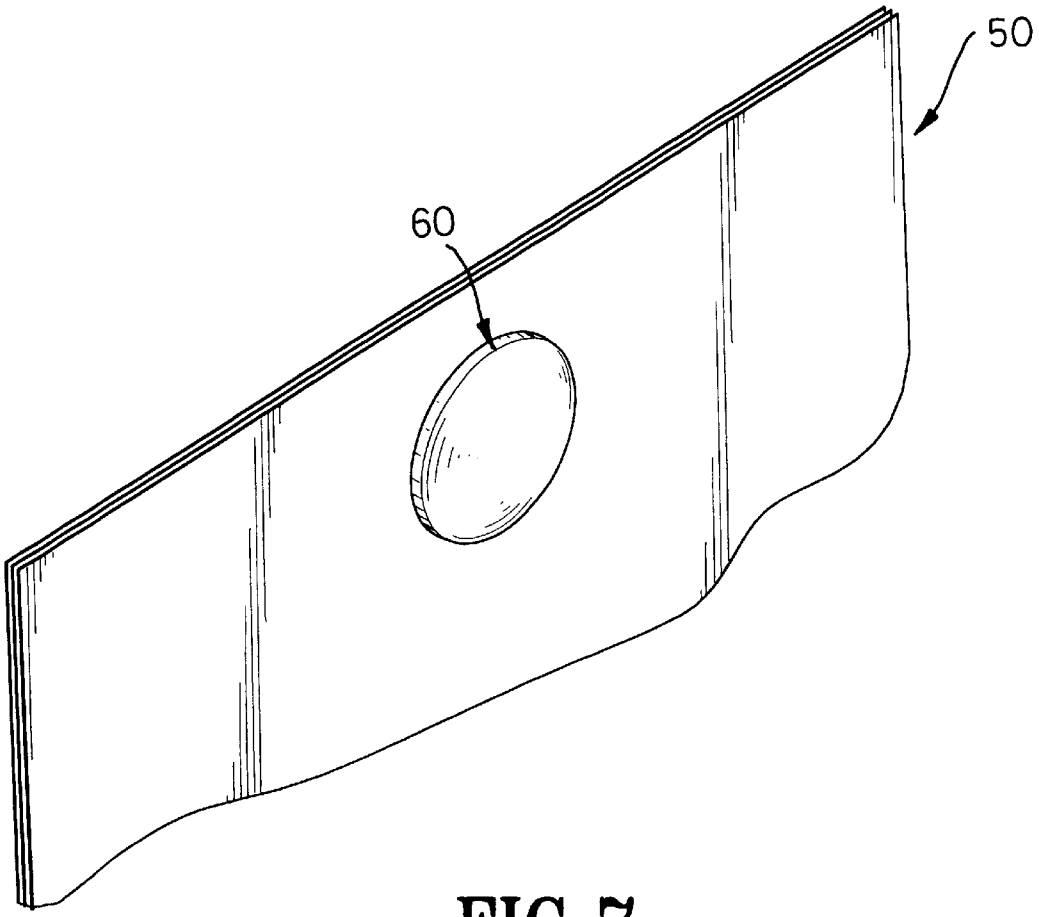
FIG. 7 PRIOR ART
FIG. 7 is a perspective view of a conventional paper attachment device in accordance with the prior art.

With reference to FIG. 6, another means to moveably connect the cap (10) to the other elements of the paper attachment device in accordance with the present invention is an enlarged head (111) formed on the stud in the counter sunk hole (41). The enlarged head (111) firmly attaches the cap (10) to the cup (20) and obviates the need for a bolt (44).

Although the invention has been explained in relation to its preferred embodiment, it is to be understood that many other possible modifications and variations can be made without departing from the spirit and scope of the invention as hereinafter claimed.

What is claimed is:

1. A paper attachment device in accordance with the present invention comprising:

a cap (10) having a stud (11);

a cup (20) movably attached to the cap (10) and having a through hole (21) defined through the cup (20) and penetrated by the stud (11) of the cap (10);

a driving plate (30) movably accommodated inside the cup (20) and having:

a housing (32) with a top surface (34) formed on the driving plate (30);

multiple resilient arms (35) formed on the top surface (34) of the housing (32) to press the cup (20) outwardly; and a hole (36) defined through the housing (32) to align with the through hole (21) in the cup (20);

a magnet (40) mounted inside the housing (32) of the driving plate (30) and having a counter sunk hole (41) defined through the magnet (40) to align with the hole (36) in the driving plate (30); and means to moveably connect the cap (10) to the other elements of the paper attachment device provided on the stud (11).

2. The paper attachment device as claimed in claim 1, wherein the multiple resilient arms (35) are evenly formed on the top surface (34) of the housing (32) around the hole (36).

3. The paper attachment device as claimed in claim 2, wherein the cap (10) is a dome with an opening, a flat edge around the opening and a recess with a center;

the stud (11) extends from the center of the recess toward the cup (20) and has a threaded hole (110) defined longitudinally along the stud (11); and the means to moveably connect the cap (10) to the other elements of the paper attachment device is a bolt (44) mounted in the counter sunk hole (41) and screwed into the threaded hole (110) in the stud (11).

4. The paper attachment device as claimed in claim 3, wherein the cup (20) is a dome with an inner recess (23) to receive the driving plate (30) inside.

5. The paper attachment device as claimed in claim 2, wherein the cup (20) is a dome with an inner recess (23) to receive the driving plate (30) inside.

6. The paper attachment device as claimed in claim 1, wherein the cap (10) is a dome with an opening, a flat edge around the opening and a recess with a center; and the stud (11) extends from the center of the recess toward the cup (20) and has a threaded hole (110) defined longitudinally along the stud (11); and the means to moveably connect the cap (10) to the other elements of the paper attachment device is a bolt (44) mounted in the counter sunk hole (41) and screwed into the threaded hole (110) in the stud (11).

7. The paper attachment device as claimed in claim 1, wherein the cup (20) is a dome with an inner recess (23) to receive the driving plate (30) inside.

8. The paper attachment device as claimed in claim 1, wherein the means to moveably connect the cap (10) to the other elements of the paper attachment device is an enlarged head (111) formed on the end of the stud (11) in the counter sunk hole (41).

* * * * *